US006155700A

United States Patent [19]

Hsu

[11] Patent Number: 6,155,700

[45] Date of Patent: Dec. 5, 2000

[54] TOUCH-CONTROL LIGHT EMITTING APPARATUS

[76] Inventor: Ming-Tay Hsu, P.O. Box 82-144, Taipei, Taiwan

[21] Appl. No.: 09/276,639

[22] Filed: Mar. 26, 1999

[51] Int. Cl.[7] ..... F21V 3/00

[52] U.S. Cl. ..... 362/363; 362/196; 362/253

[58] Field of Search ..... 362/196, 202, 362/203, 205, 206, 208, 363, 800, 809, 253; 446/485, 439

[56] References Cited

U.S. PATENT DOCUMENTS

| | | | |
|---|---|---|---|
| 3,011,048 | 11/1961 | O'Brien | 362/809 |
| 5,763,845 | 6/1998 | Hsieh | 362/205 |
| 5,775,800 | 7/1998 | Hsieh | 362/809 |

*Primary Examiner*—Y. Quach
*Attorney, Agent, or Firm*—A & J

[57] ABSTRACT

A touch-control light emitting apparatus comprising a hollow housing, a battery seat, a light emitting body, a light emitting body seat, a plurality of batteries, a spring, a touch button module, characterized in that the battery seat is formed within the hollow housing and is provided with a plurality of batteries, the light emitting body is mounted with the light emitting body having a short contacting leg passed through the light emitting body seat and in contact with the positive terminal of the battery, a long contacting leg provided within the vertical slot across the light emitting body seat and the battery seat, the end of the long contacting leg being in contact with the top end of the spring, the top end of the battery also serially connected to the bottom of the battery seat, the lower end of the spring is in contact with a metal cap having being connected to a touch button at the bottom thereof, the touch button is pivotally mounted at an opening provided at the bottom of the hollow housing; thereby when the touch button is pressed, the metal cap moves upward to contact with the negative terminal of the battery within the battery seat such that the negative current passes through the metal cap and the spring to the long contacting leg, and the light emitting body is then lighted.

4 Claims, 4 Drawing Sheets

TOUCH-CONTROL LIGHT EMITTING APPARATUS

BACKGROUND OF THE INVENTION (a) Field of the Invention

The present invention relates to a touch-control light emitting apparatus, and in particular, to a light emitting apparatus suitably mounted onto toys, stationeries, decorative articles or lighting equipments such that light is produced by touching a button switch of the apparatus.

(b) Description of the Prior Art

In conventional light emitting apparatus, a vibration switch or the like is mounted within the apparatus such that vibrating the apparatus triggers the switch of the circuit therein and the light emitting apparatus (such as LED) is switched on and lighted. The conventional vibration switch or the like which causes the circuit to close, is formed from small steel balls, spring, spring blades, eccentric block and/or balancing lever.

Conventional type of touch-triggering switches (or the like) in switching a light emitting apparatus is of great sensitivity that the light emitting apparatus is lighted continuously with a slight touch. This will cause a rapid exhaustion of batteries, and new batteries are needed to replace the exhausted batteries. If the light emitting apparatus is mounted within a closed or sealed type compartment (for example toys or article formed as a unit), if the batteries are exhausted and not replaceable, the light emitting apparatus can no longer provide lighting. Thus, not all lighting article can employ too sensitive touch-triggering switch as an on-off switch and in this case, a touch-control switch has to be employed in the light emitting apparatus.

SUMMARY OF THE PRESENT INVENTION

Accordingly, it is an aspect of the present invention to provide a touch control light emitting apparatus comprising a hollow housing, a battery seat, a light emitting body, a light emitting body seat, a plurality of batteries, a spring, a touch button module, and characterized in that the battery seat is formed within the hollow housing and is provided with a plurality of batteries, the light emitting body is mounted with the light emitting body having a short contacting leg passed through the light emitting body seat and in contact with the positive terminal of the battery, a long contacting leg provided within a vertical slot across the light emitting body seat and the battery seat, the end of the long contacting leg is in contact with the top end of the spring, the top end of the battery is connected in series to the bottom of the battery seat, the lower end of the spring is in contact with a metal cap having being connected to a touch button at the bottom thereof, the touch button is pivotally mounted at an opening provided at the bottom of the hollow housing; thereby when the touch button is pressed, the metal cap moves upward to contact with the negative terminal of the batteries within the battery seat such that the negative current passes through the metal cap and the spring to the long contacting leg, and the light emitting body is then lighted.

It is an object of the present invention to provide a touch-control light emitting apparatus, wherein the light emitting body and the light emitting body seat, the battery and the battery seat, the spring, the blocking nut and the press button are mounted within the hollow housing and have a common center axis.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE PRESENT INVENTION

Figure 1:
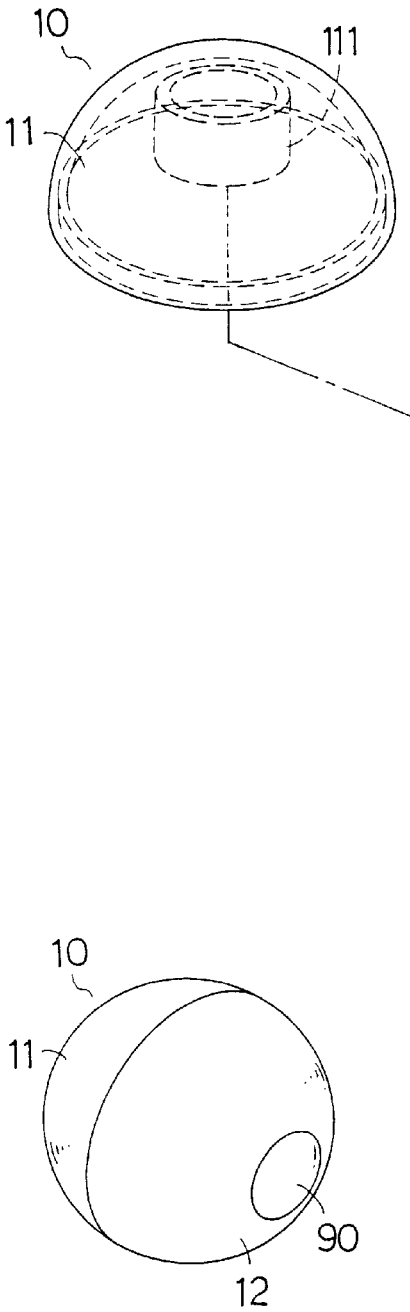
FIG. 1 is a perspective view of the light emitting apparatus in accordance with the present invention.
Figure 2:
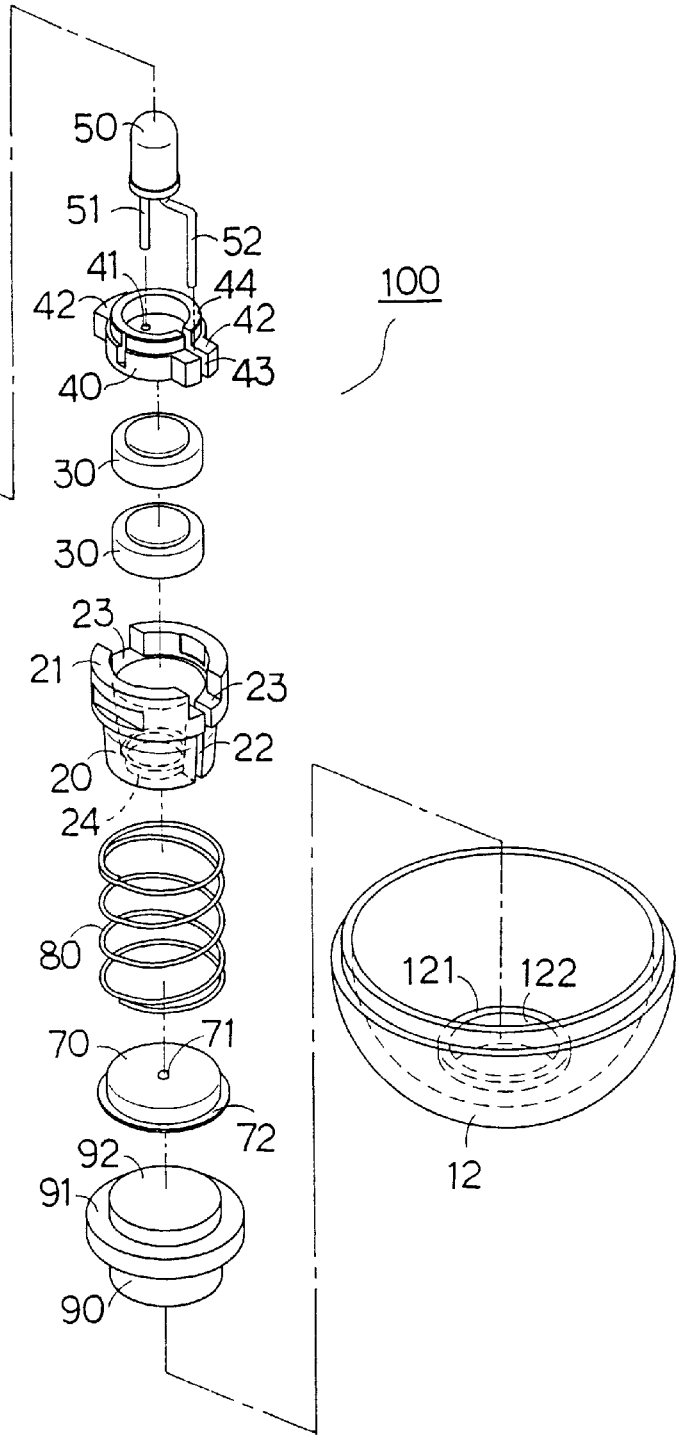
FIG. 2 is an exploded perspective of the light emitting apparatus in accordance with the present invention.

FIGS. 1 and 2 respectively show the perspective view and exploded view of the light emitting apparatus in accordance with the present invention. As shown in FIGS. 1 and 2, the light emitting apparatus 100 comprises a hollow housing 10, a battery seat 20, a light emitting body 50, a light emitting body seat 40, a plurality of batteries 30, a spring 80, a touch button module 90 combined together. In accordance with the present invention, the hollow housing 10 consists of an upper housing 11 and a lower housing 12 being mounted to each other or screwed or welded together, or glued together. The shape of the housing 10 can be round, oval, square or other shape. At the top section of the interior of the upper housing 11, a blocking channel 111 is provided, and an opened slot 121 is provided at the bottom section of the interior of the lower housing 12. Within the opened slot 121, an opening 122 is provided. The blocking channel 111 and the opened slot 121 are corresponding to each other.

Figure 3:
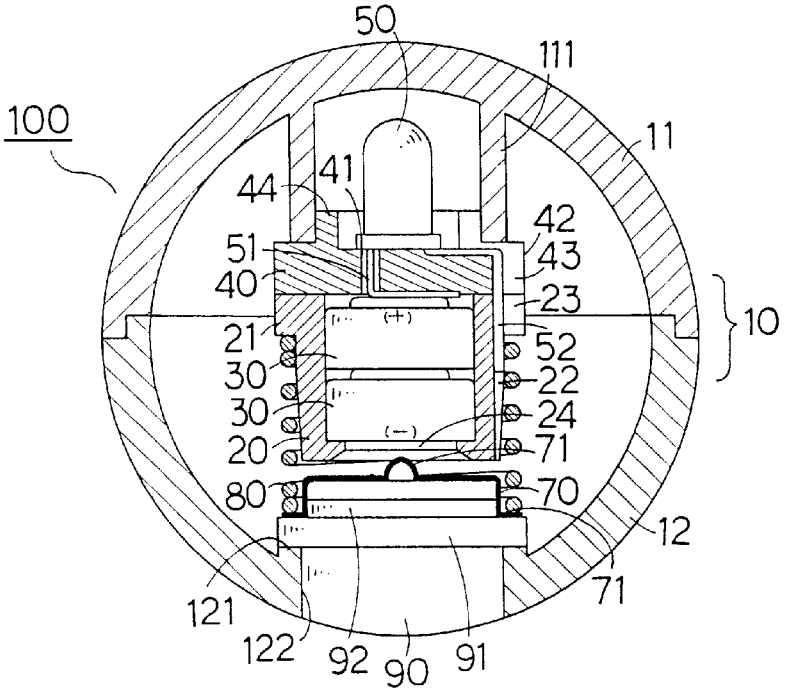
FIG. 3 is a sectional view of the light emitting apparatus (no light is produced) in accordance with the present invention.
Figure 4:
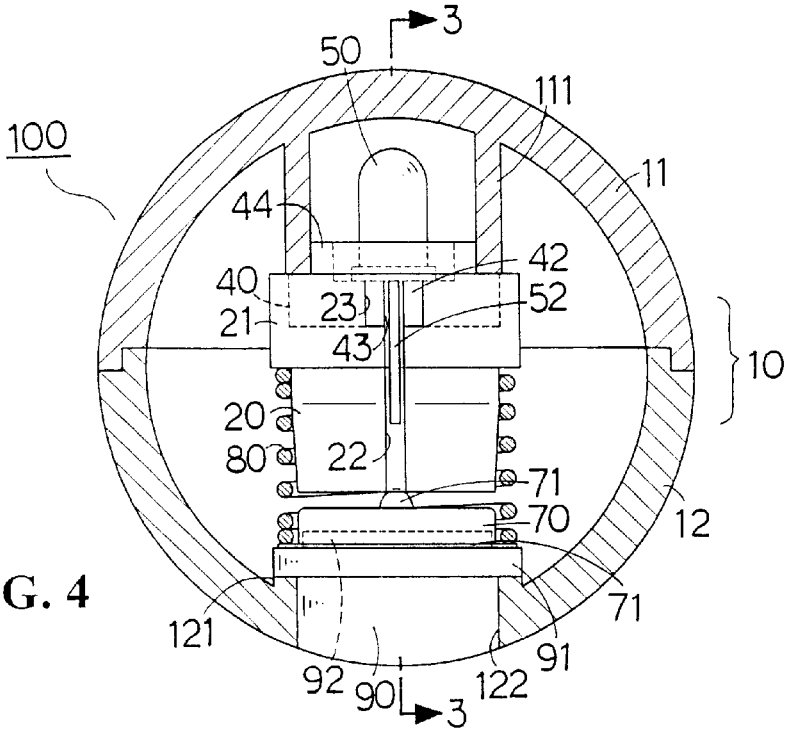
FIG. 4 is a partial sectional view of the light emitting apparatus in accordance with the present invention.

Referring to FIGS. 3 and 4, there is shown the sectional view of the light emitting apparatus in accordance with the present invention. The battery seat 20 is mounted within the hollow housing 10 and a plurality of batteries 30 are installed within the battery seat 20. The light emitting body seat 40 is mounted at the top end of the battery seat 20 and is provided with a light emitting body 50 (for example: LED) having a short contacting leg 51 passed through a small opening 41 at the light emitting body seat 40 and then bent at an angle of 90 degree. The short contacting leg 51 is in contact with the positive terminal of the batteries 30 connected in series. The light emitting body 50 also has a long contacting leg 52 provided across the recesses 43,22 of the light emitting body seat 40 and the battery seat 20. The recesses 43, 22 are corresponding to each other (refer to FIG. 4) and therefore the long contacting leg 52 is first bent at an angle of 90 degree and then extended vertically. The end section of the leg 52 is in contact with the upper end of the spring 80 (refer to FIG. 3).

In accordance with the present invention and as shown in FIG. 3, an opening 24 is formed at the bottom of the battery seat 20. A metal cap 70 is provided at the bottom of the opening 24. A protrusion 71 is at the center of the metal cap 70 and a protruded rim 72 is mounted at the bottom section of the metal cap 70. The spring 80 is provided in between the battery seat 20 and the metal cap 70.

The top end of the spring 80 urges a recess 21 at the battery seat 20 and the bottom end of the spring 80 urges the protruded rim 72 of the metal cap 70. The battery seat 20 is urged by the spring 80 such that the seat 20 is at a suspended position.

As shown in FIGS. 3 and 4, the light emitting body seat 40 is mounted to the battery seat 20. As a result of the protruded slot 44 of the light emitting body seat 40 being engageable with the blocking channel 111 of the upper housing 11, when the spring 80 pushes the battery seat 20, the blocking channel 111 stops the light emitting body seat 40 from moving upward. Accordingly, the blocking channel 111 positions the body seat 40.

Referring to the Figures, the bottom of the metal cap 70 is provided with a touch button 90 having a protruded edge 91 at the external edge of the button 90. The protruded edge 91 blocks the button 90 from protruding out of the opening 122. At the top of the button 90, a raised disc 92 is provided and is engageable with the metal cap 70, such that the metal cap 70 is positioned on top of the touch button 90. The metal cap 70 and the touch button 90 can be formed as an integrated metal body. However, the combination of the metal cap 70 and the touch button 90 provides an effective way of moist protection.

The recess 21 of the battery seat 20 as shown in FIG. 2 has two symmetrical framed slots 23, wherein one of the framed slots 23 is provided with downwardly extended recess 22. The light emitting body seat 40 can be adapted to the recess 21 and the protruded block 42 at the two edges of the light emitting body seat 40 can be inserted into the framed slot 23 at the same time. In addition, the recess 43 is extended from the protruded slot 44 downward and passes one of the protruded block 42. The recesses 43 and 22 are corresponding to each other. When the light emitting body 40 is mounted to the battery seat 20, the body 40 shall be fixed and is not moveable.

Referring to FIG. 4, before the touch button 90 is pressed, the protrusion 71 at the metal cap 70 does not contact with the negative terminal of the battery 30, but the short contacting leg 51 of the light-emitting body 50 is kept in contact with the positive terminal of the battery 30. When the other long contacting leg 52 does not touch the negative current, the light emitting body 50 does not produce light.

Figure 5:
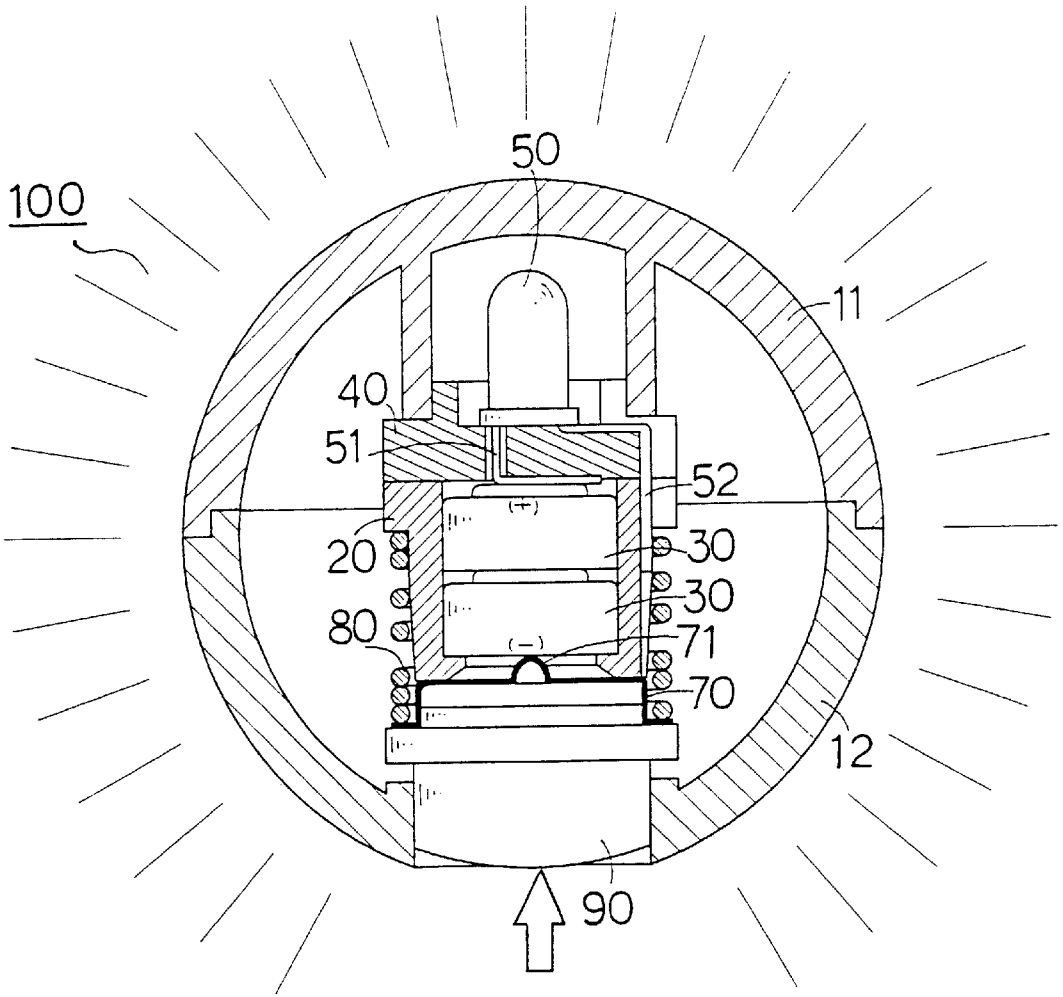
FIG. 5 is a sectional view of the light emitting apparatus (light is produced) in accordance with the present invention.

Referring to FIG. 5, when the user touches the touch button 90, the metal cap 70 is urged to move upward and the protrusion 71 is in contact with the negative terminal of the battery 30. At this instant, the negative current passes through the metal cap 70, and the spring 80, and the current is transferred to the long contacting leg 52 of the light emitting body 50. Thus, the light emitting body 50 produces light when the current passes through the short contacting leg 51 and long contacting leg 52. On the other hand, when the touch button 90 is not pressed, the spring 80 restores to its original position and the metal cap 70 and the touch button 90 simultaneously restores to the position as shown in FIG. 3. No light is produced by the light emitting body 50 when no current passes to the long contacting leg 52.

Figure 6:
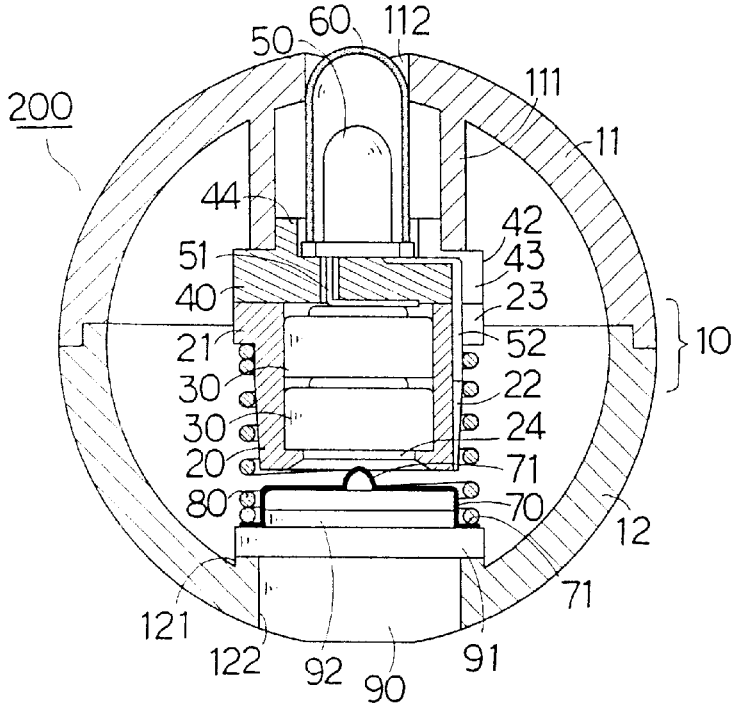
FIG. 6 is a sectional view of another preferred embodiment (no light is produced) in accordance with the present invention.
Figure 7:
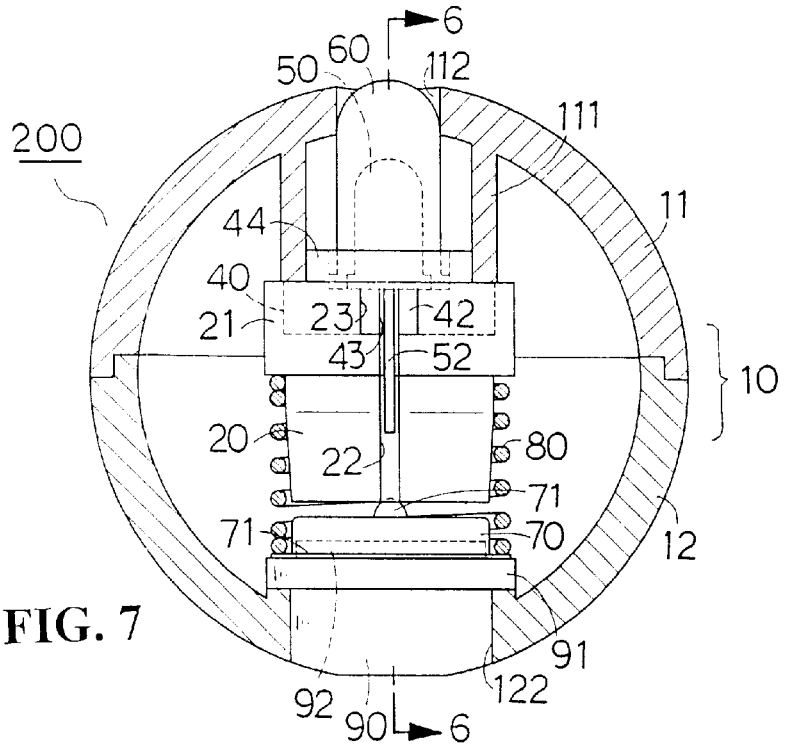
FIG. 7 is a partial sectional view of another preferred embodiment in accordance with the present invention.

Referring to FIGS. 6 and 7, there is shown other preferred embodiment of light emitting apparatus in accordance with the present invention. FIG. 6 is a sectional view along line 6—6 of FIG. 7. As shown in the figures, the light emitting apparatus 200 is similar to that of FIGS. 3 and 4. However, a light mask 60 is provided to the light emitting body seat 40, and the light mask 60 can cover the light emitting body 50. The light mask 60 has a protective function and also has a function of keeping away from dust. In accordance with the present invention, the top end of the light mask 60 protrudes above a center hole 112 of the block channel 111 of the upper housing 11 such that light ray can be emitted via the light mask 60 and does not pass through the upper housing 11.

In accordance with the present invention, the end terminal of the touch button 90 of the light emitting apparatus can be connected to a key chain. During the night, it can be switched on by touching the button so as to facilitate door opening of a house or of a vehicle. Furthermore, the light emitting apparatus can be mounted to a pen such that the top end of the ink core of the pen is connected to the touch button 90. Accordingly, the touch button 90 will cause the light emitting apparatus to be lighted when writing.

The advantages of the present invention are as follows:

(1) The structure is simple and can be easily assembled and suitable for mass production.

(2) The shape is compact and can be easily hold. The switch can be easily turned on and the operation of the apparation is convenient.

(3) Small size and does not occupy space. This allows carrying along by the user.

(4) It can be used as an illumination device at night.

(5) It can be used as a warming indication at night and can be used safely.

(6) It provides fun to the children and suitable to be used as playing toys for children.

Various other modifications may occur to those skilled in the art without departing from the true spirit and scope of the invention as defined by the appended claims.

What is claimed is:

1. A touch-control light emitting apparatus comprising a hollow housing, the hollow housing essentially comprised of an upper housing and a lower housing of symmetrical shape connected to each other, a battery seat formed within the hollow housing and receiving a plurality of batteries, a light emitting body seat within the hollow housing, a light emitting body having a short contacting leg passed through the light emitting body seat and in contact with a positive terminal of the batteries, the light emitting body having a long contacting leg provided within a plurality of vertical slots across the light emitting body seat and the battery seat, an end of the long contacting leg in contact with a top end of the spring within the hollow housing, a top end of the batteries electrically connected in series to a bottom of the battery seat, a lower end of the spring in contact with a metal cap, a bottom of the metal cap connected to a touch button in the lower housing, and the touch button pivotally mounted at an opening, formed at a bottom of the hollow housing, with the metal cap having a protrusion moving upward to contact with a negative terminal of the batteries within the battery seat, when the touch button is pressed, such that a negative current passes through the metal cap and the spring to the long contacting leg, to light the light emitting body.

2. The touch-control light emitting apparatus as set forth in claim 1, wherein an opening is formed in a blocking channel of the upper housing, a light mask is mounted to the light emitting body seat and covers the light emitting body, and a top end of the light mask exposed at the opening of the upper housing.

3. The touch-control light emitting apparatus as set forth in claim 1, wherein a recess is formed at a top end of the battery seat to connect with the light emitting body seat, a pair of symmetrical framed slots are formed on the battery seat and adjacent to the recess for engaging with a pair of protruded blocks on lateral sides of the light emitting body seat so that light emitting body seat is rigidly secured within the battery seat.

4. The touch-control light emitting apparatus as set forth in claim 1, wherein the vertical slot of the battery seat is formed within a framed slot on the battery seat and is extended downward from a recess, in the battery seat and adjacent the framed slot, toward the metal cap, the vertical slot of the light emitting body seat is formed in a protruded block, formed on the light emitting body seat, and is extended downward toward the battery seat, and the vertical slots are symmetrically mounted such that the long contacting leg of the light emitting body extending vertically downward toward the metal cap after being bent at an angle of 90 degrees.

* * * * *